United States Patent [19]

de Nouël

[11] 4,031,646

[45] June 28, 1977

[54] SUSPENDIBLE FILING FOLDER

[75] Inventor: Chantal de Nouël, Paris, France

[73] Assignee: Societe d'Exploitation de la S.A. Henri Malsert, Lyon, France

[22] Filed: Oct. 21, 1975

[21] Appl. No.: 624,395

[30] Foreign Application Priority Data

Oct. 21, 1974 France ..... 74.35241

[52] U.S. Cl. ..... 40/359

[51] Int. Cl.[2] ..... B42F 21/00

[58] Field of Search ..... 40/10, 359, 360; 312/184

[56] References Cited

UNITED STATES PATENTS

| | | | |
|---|---|---|---|
| 2,677,910 | 5/1954 | Morgan | 40/158 |
| 2,825,160 | 3/1958 | Mellor et al. | 40/10 R |
| 2,874,699 | 2/1959 | Dunleavy | 40/359 |

*Primary Examiner*—Hugh R. Chamblee
*Assistant Examiner*—Wenceslao J. Contreras
*Attorney, Agent, or Firm*—Arnold, White & Durkee

[57] ABSTRACT

A vertically suspendible filing folder configured for temporarily linking adjacent filing folders to one another for convenience in locating, handling, grouping, sorting and storing. A filing folder is affixed to suspension bars, the ends of which are fitted with suspension hooks suitable to permit a suspendible filing folder to glide between two parallel horizontal rails. A permanent magnet is affixed to one of the two suspension bars so as to expose the magnet toward the outside of the filing folder. The other suspension bar has a region of ferromagnetic material exposed toward the outside of the folder in opposing position to the magnet. The magnetic attraction between the permanent magnet affixed to the suspension bar of one folder and the ferromagnetic region of the suspension bar of an adjacent folder of similar design accomplishes the provisional linking. In this manner, a convenient and temporary combining between two or more adjacent filing folders is effective so as to maintain the folders in customary and attractive appearance. The linked folders are separated with the same convenience when the need to do so arises.

7 Claims, 6 Drawing Figures

FIG. 4
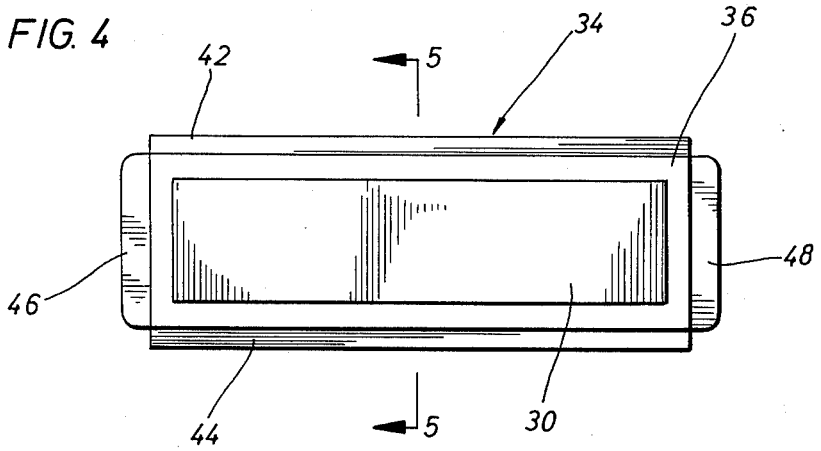
FIG. 5
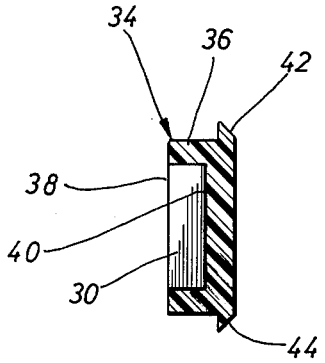
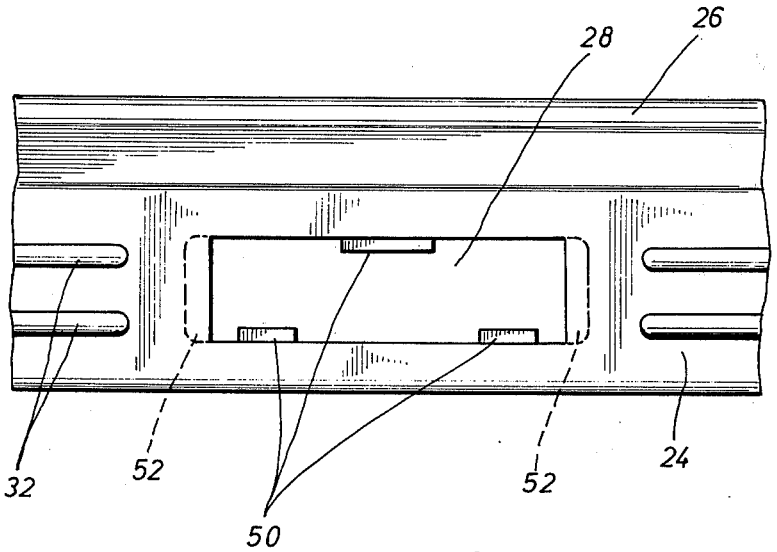
FIG. 6

SUSPENDIBLE FILING FOLDER

BACKGROUND OF THE INVENTION

The invention relates to a new configuration in suspendible filing folders of cardboard, plastics or other nonmagnetic materials.

For convenience in locating, sorting, handling, as well as other reasons, the need frequently arises to combine two or more suspendible folders in a temporary manner so as to better separate and arrange these folders with respect to adjacent folders or groups of folders. This need leads to equipping each filing folder with a means for provisional or temporary attachment to an adjacent folder.

Such means may consist, for example, of mechanical devices such as pins, paper clips, or clamps, which devices would be fastened to the suspension bars affixed to the folders. Experience has demonstrated, however, that the coupling or linking of folders by these devices is not always convenient or dependable. Moreover, the disengagement of such devices can also be inconvenient.

Recognition of this need has led to a proposal to link adjacent suspendible folders by magnetic means. Thus, French Pat. No. 1,191,584 recommends insertion of a magnet enclosed in a pocket fitted to the outside of each face of the folder with each magnet being capable of causing the magnetic attraction of a soft iron plate in a pocket situated on the opposite face of a similarly fitted adjacent folder.

This particular arrangement has the disadvantage of creating a bulge on the faces of the folders and imparting to these faces as asymmetry, detracting both from the appearance of the folder and its physical flexibility in use. This design also makes face-to-face positioning of the folders difficult because of the irregular position the folders assume.

SUMMARY OF THE INVENTION

The novel suspendible filing folder in accordance with this invention comprises a pair of suspension bars, for example bars adapted to be suspended from tracks in a filing cabinet, which support a closed-bottom envelope. Such envelopes, for purposes of holding documents within the file, are well known in the art and typically comprise a single flexible sheet of heavy paper or like material fixed at its upper ends to the respective suspension bars. Alternatively, however, the envelope in accordance with this invention may comprise an open-topped container having frontal and rearward panels as well as bottom and side panels to positively retain documents therein. As will be appreciated, the envelope in accordance with this invention may include partitions within the envelope so that subdivisions of the material filed in each individual folder may be established. Most typically, however, the envelope in accordance with this invention is in the form of a folder, comprising only forward and rearward panels, providing a closed-bottom receptacle for documents or other material to be filed.

The object of this invention is to eliminate the disadvantages of present similar configurations of suspendible filing folders by recourse to a magnetic means for the provisional or temporary linking of two or more folders.

The invention comprises a pair of suspension bars which are affixed to the upper ends of a closed-bottom envelope. A permanent magnet disposed facing outwardly is affixed to one of the suspension bars. The other suspension bar has a region of ferromagnetic material disposed facing outwardly so as to attract and engage the magnet of an adjacent folder. Linking in seriatim is accomplished in this fashion.

An additional advantage of the present invention is that the side of the filing folder to which the permanent magnet is affixed may support the identification signals of the folder, i.e. the title-holder.

In other words, the suspendible filing folder according to the invention comprises:

- a cardboard, plastic or nonmagnetic material envelope essentially comprising two faces which are joined at the bottom;
- a pair of suspension bars affixed parallel to the envelope bottom at each of the upper ends of the filing envelope;
- hooks placed at the ends of said suspension bars and suitable for the suspendible folder to glide on between two parallel horizontal rails;
- a permanent magnet disposed facing outwardly on one of the suspension bars; and
- a region of ferromagnetic material disposed facing outwardly on the other suspension bar in opposing position to the magnet for magnetically engaging the magnet on an adjacent folder.

The foregoing, and other arrangements, features, and advantages of the invention, will become apparent from the following more particular description of the preferred embodiment of the invention, as illustrated in the accompanying drawings.

BRIEF DESCRIPTION OF THE DRAWINGS

FIGS. 4 and 5 are a frontal and side views, respectively of the permanent magnet and, magnet housing; and FIG. 6 is an embodiment of the window housing of the title-holder bar which is intended to receive the permanent magnet and magnet housing.

DESCRIPTION OF THE PREFERRED EMBODIMENT

Figure 1:
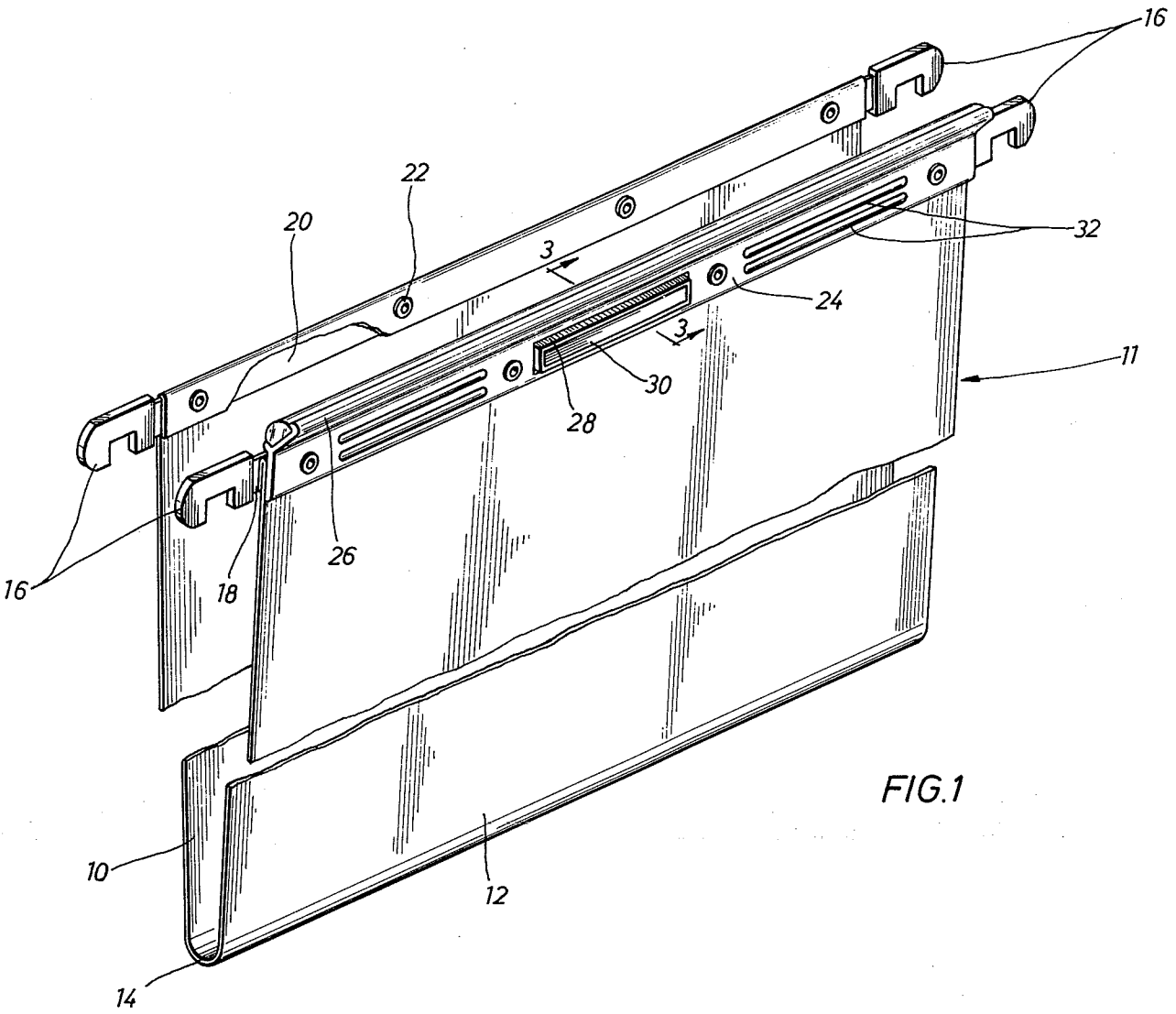
FIG. 1 is the present invention in perspective with primary parts identified.
Figure 2:
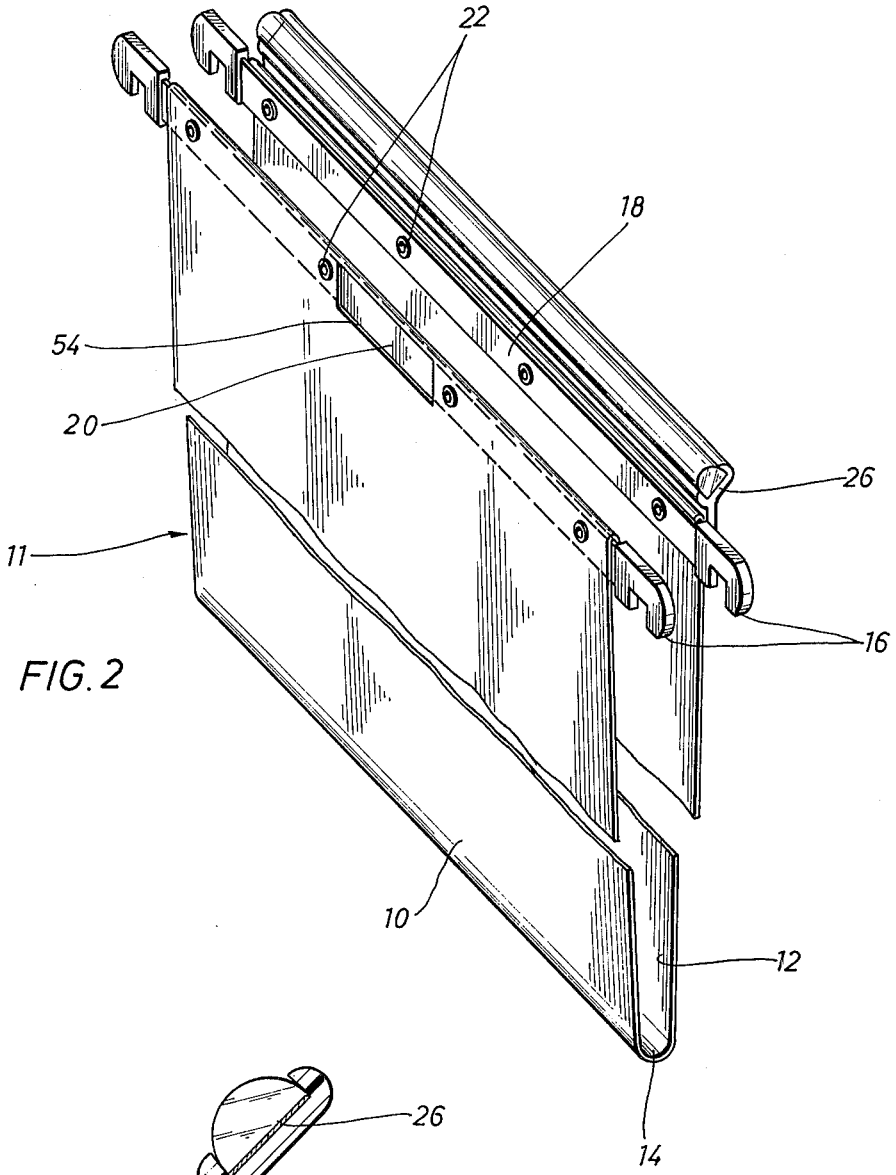
FIG. 2 is a further view in perspective with the folder in a position suitable for being provisionally linked to a preceding filing folder.

Referring to FIGS. 1 and 2, there is shown a suspendible file folder wherein two suspension bars 18 and 20 suspend an envelope 11. In the illustrated embodiment, envelope 11 comprises a single flexible sheet of heavy duty material which, when folded, forms folder faces 10 and 12 as well as folder bottom 14. It will be appreciated by those skilled in the art that the envelope may take other shapes including having separate side panels in order to retain the material within the folder. In addition, the folder may be comprised of two separate folder faces mechanically joined at the bottom. Hence, it will be understood by those skilled in the art that any suitable filing receptacle for documents which may be suspended between two suspension bars adapted to ride a track in a filing cabinet may be used in accordance with the description of the suspendible filing folder of this invention.

Referring to FIGS. 1 and 2, the two folder faces 10 and 12, for example of cardboard, are joined at the folder bottom 14 so as to form a U or V shape in order to permit the filing folder to receive documents (not shown) to be filed. The two suspension bars 18 and 20, for example of metal material, are affixed parallel to folder bottom 14 at each free end of folder faces 10 and 12. Suspension bars 18 and 20 are secured in a conventional manner, for example, by rivets 22, to the corresponding folder faces of the filing folder. Folder face 10 can completely envelop suspension bar 20 as shown, or folder face 10 can be applied only to a single side of suspension bar 20. Hooks 16, for example of a plastic material, are molded onto the free ends of suspension bars 18 and 20 so as to allow the suspendible filing folder to glide in a known manner on two parallel horizontal rails (not shown).

To the horizontal side at the top of folder face 12, there is mounted a title-holder bar 24 integral to an inclined title-holder 26 forming a support for an inscription band where the identification signals of the folder (band and signals are not shown in the Figures) are presented in a known manner. The title-holder may be of the kind for example described in French Pat. No. 1,444,289 of a thermoplastic material and produced by injection molding. Title-holder bar 24 is fastened by rivets 22 to suspension bar 18 by interposing between the suspension bar and the title-holder bar the upper horizontal side of envelope face 12 of the filing envelope.

Figure 3:
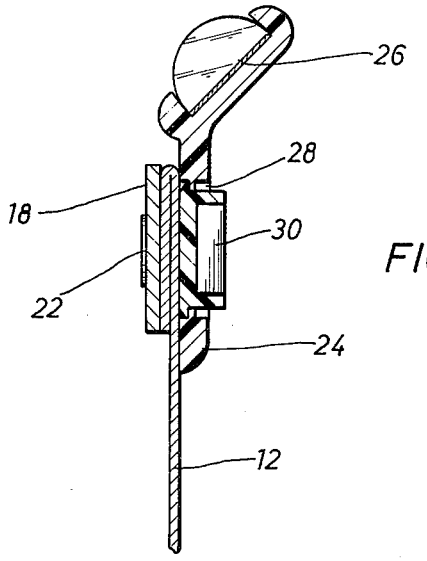
FIG. 3 is a partial section taken along line 3—3 of the portion of FIG. 1 containing the permanent magnet.

At its median portion, title-holder bar 24 contains a window housing 28 which serves to hold a magnet housing 34 of theromplastic material. Magnet housing 34 provides an internal chamber wherein permanent magnet 30 is held. (See also FIG. 3.) Permanent magnet 30 is of parallelepipedonal shape of thin thickness.

As shown in FIGS. 4 and 5, one of the permanent magnet's major faces 38 is exposed to the outside of the filing folder while the opposite face 40 is applied against the back of the chamber of magnet housing 34.

The retention of magnet housing 34 in window housing 28 is insured by any convenient means; for example, the rims of the window housing may be formed of resilient lips which move apart so as to accommodate magnet housing 34 within the lips.

Advantageously, title-holder bar 24 is reinforced by longitudinal ribs 32.

In FIG. 2 which illustrates a view in perspective of folder face 10, it can be seen that at the median portion of suspension bar 20, the folder face material of face 10 is cut out so as to form window 54. The positioning of window 54 leaves exposed a portion of suspension bar 20 which is parallel to the major axis of permanent magnet 30, thereby permitting a direct, and hence efficient, contact between the permanent magnet affixed to folder face 12 of one filing folder and suspension bar 20 of folder face 10 of an adjacent folder.

In practice, window 54 need not be provided when the thickness of the cardboard or plastic material of the filing folder enables a sufficient magnetic attraction between permanent magnet 30 and suspension bar 20 affixed to folder face 10.

FIGS. 4 and 5 show in greater detail magnet housing 34. Magnet housing 34 is comprised of parallelepipedonal rectangular support 36 of plastic material, for example of polypropylene, wherein permanent magnet 30, one of the faces 38 of which is exposed and the other 40 immersed in a plastic material, is maintained. The major sides of rectangular support 36 have two catches 42 and 44 which extend over the length of the minor sides of webs 46 and 48.

Window housing 28 in title-holder bar 24 has at the rear of the visible housing face housing tabs 50 and housing hollows 52. Tabs 50 are designed to receive and retain catches 42 and 44 of magnet housing 34. Hollows 52 are designed to receive and retain webs 46 and 48 of magnet housing 34.

Magnet housing 34 is manually forced into window housing 28 so as to expose face 38 of permanent magnet 30 to the outside of the filing folder.

The rectangular shape of catches 42 and 44 and housing tabs 50 and their orientation are such that magnet housing 34 cannot be withdrawn toward the outside of the filing folder. Suspension bar 18 forms a retention means for magnet housing 34 to prevent the magnet housing from being withdrawn toward the inside of the filing folder once the magnet housing has been placed in position.

In the described and illustrated embodiment, the filing folders would rest and glide on two parallel horizontal rails. If desired, these rails may be replaced by well-known parallel linear supports such as tubes from which the filing folders would be suspended by suspension hooks of suitably adapted design.

As the invention discloses, the provisional adherence of one folder to another for purposes of grouping, sorting, locating, selecting, etc. is obtained in a simple and convenient manner. The linked folders are separated with the same ease when the need to do so arises.

The described embodiment permits the folders to be kept in customary attractive appearance and in no way interferes with the physical flexibility of the folder faces, their ready manipulation, or otherwise occupies an unnecessarily large amount of space.

It should also be noted that the advantageous temporary cohesion of the magnetically-combined filing folders prevents documents from being placed outside these filing folders as could happen with some of the prior art arrangements.

The foregoing description of the invention has been directed in primary part to a particular preferred embodiment in accordance with the requirements of the Patent Statutes and for purposes of explanation and illustration. It will be apparent, however, to those skilled in this art that many modifications and changes in the specific apparatus utilized may be made without departing from the scope and spirit of the invention. For example, a plurality of magnets disposed facing outwardly may be affixed to the rearward suspension bar so as to engage more securely the frontward suspension bar of an adjacent folder which bar would be comprised entirely of a ferromagnetic material. It is applicant's intention in the following claims to cover such modifications and variations as fall within the true spirit and scope of the invention.

What is claimed is:

1. A vertically suspendable filing folder comprising:

a pair of suspension bars having means at the ends thereof to engage a support;

an envelope with a closed bottom affixed at its upper ends to said suspension bars;

a non-magnetizeable housing attached to one of said suspension bars for mounting a magnetic element thereto;

a permanent magnet disposed within said non-magnetizeable housing and surrounded thereby so as to have a surface thereof facing outwardly from said one of said suspension bars; and, a region of ferromagnetic material disposed facing outwardly on the other of said suspension bar in opposing position to said magnet for magnetically engaging the magnet of an adjacent folder.

2. A filing folder as recited in claim 1, wherein said suspension bars are comprised entirely of ferromagnetic material.

3. A filing folder as recited in claim 1, wherein said ferromagnetic material of said other suspension bar is openly exposed.

4. A filing folder as recited in claim 1, wherein said permanent magnet is of rectangular shape and affixed to the central portion of said suspension bar.

5. A filing folder as recited in claim 1, wherein a title-holder bar is affixed to one of said suspension bars.

6. A filing folder as recited in claim 1, wherein said non-magnetizable housing comprises a substantially rectangular member having an internal chamber sized to receive said magnet, a first and second catch extending along the major sides of the rectangular member and a first and a second web extending along the minor sides of the rectangular member.

7. A filing folder as recited in claim 6, wherein said one of said suspension bars has a substantially rectangular window sized to receive said non-magnetizeable housing therein, said suspension bar having housing tabs and housing hollows disposed adjacent to said window, said tabs receiving and retaining said catches and said hollows receiving and retaining said webs when said housing is disposed within said window.

* * * * *